US005191752A

United States Patent [19]

Murphy

[11] Patent Number: 5,191,752

[45] Date of Patent: Mar. 9, 1993

[54] ELASTOMERIC GEL SADDLE

[76] Inventor: Robert J. Murphy, 602 Woburn Dr., Camillus, N.Y. 13031

[21] Appl. No.: 878,365

[22] Filed: May 4, 1992

[51] Int. Cl.[5] ..... B68C 1/02

[52] U.S. Cl. ..... 54/44.5; 54/44.7

[58] Field of Search ..... 54/44.1, 44.4, 44.5, 54/44.7, 66; 297/214

[56] References Cited

U.S. PATENT DOCUMENTS

| | | | |
|---|---|---|---|
| 1,213,329 | 1/1917 | Beal | 54/44.1 |
| 1,824,488 | 9/1931 | Kopf | |
| 3,258,894 | 7/1966 | Hoaglin | 54/44.7 |
| 3,312,040 | 4/1967 | Nuzzo | 54/44 |
| 3,888,070 | 6/1975 | White et al. | 54/44 |
| 4,471,538 | 9/1984 | Pomeranz et al. | 297/214 X |
| 4,815,361 | 3/1989 | Chiarella | 297/214 |
| 4,999,068 | 3/1991 | Chiarella | 297/214 X |
| 5,119,618 | 6/1992 | Streck | 54/66 |
| 5,121,962 | 6/1992 | Weber et al. | 297/214 |

OTHER PUBLICATIONS

General Electric Silicon Product Data RTV 6157 (1991).

Avocet "Cycling's Leading Non-Prescription Pain Killer" (advertisement) (1991).

*Primary Examiner*—Robert P. Swiatek

*Attorney, Agent, or Firm*—Wall and Roehrig

[57] ABSTRACT

An equestrian saddle is made up of a saddle tree on which webbing is stretched between the cantle and head, and between the left and right frame members to provide a spring-like seat base. A seat cushion formed of a silicone dielectric gel is disposed on the seat base and is covered with a layer of muslin cloth and a pigskin or calfskin seat cover. Panels disposed beneath the saddle tree can also incorporate cushions of silicone dielectric gel. The gel material has a high energy absorbency to absorb shock and bounce of the rider on the saddle, and resilient displaceability under both vertical and lateral forces to distribute the rider's sitting weight evenly over the contact area of the saddle and avoid pressure concentrations within the contact area.

8 Claims, 5 Drawing Sheets

ELASTOMERIC GEL SADDLE

BACKGROUND OF THE INVENTION

The present invention relates to saddles for horses, of the type in which a system of webs is stretched over a saddle tree frame to form a seat base, and which further includes a cushion to distribute the rider's weight on the seat. The invention is more specifically directed to a saddle in which a gel cushion is employed to absorb shock and bounce of the rider on the saddle. The gel cushion also distributes the rider's weight evenly and avoids pressure concentrations in the contact zone of the rider on the seat. The gel cushion serves as a buffer between the rider and the saddle and a similar cushion in the panel can also serve as a buffer between the rider and the horse.

A traditional riding saddle is built on a tree frame that includes left and right side members or bars, a bow or head that joins the front ends of the bars and a cantle that joins the rear ends. A canvas web member is stretched longitudinally between the bow and the cantle, and a series of transverse webs are stretched over the longitudinal web and attached to the side bars. This produces a spring like seat base. This is covered with a thin layer of muslin or similar material, followed by a resilient seat cushion, and then a leather seat cover is stretched over the assembly. The saddle also includes panels disposed beneath the tree frame side bars to distribute the weight of the saddle and rider over the back of the horse. The panels often are formed of leather covers, with wool being stuffed inside. Additional layers are sometimes employed as a barrier to keep horse perspiration away from the wool lining.

Currently, foam rubber pads are sometimes employed as the seat cushion or as cushion members for the panels. However, foam compresses under vertical pressure and tends to collapse after sustained heavy use. Because foam compresses mostly where vertical pressure is greatest, these foam pads result in pressure concentrations near the center of the sitting contact area. Foam cushion members in the panels have similar drawbacks and tend to result in focussed pressure points where the saddle rests on the horse's withers. The weight of the rider is then focussed onto only a few points of contact, rather than being evenly distributed over the horse's back.

Foam and other resilient cushioning material is ineffective in absorbing or damping bounce and shock forces that result from normal riding activity. Bounce and shock can result in bruises to the horse or to the rider at the focussed pressure points mentioned just above.

Some previous attempts have been made to design the saddle tree so that the saddle contacts broad areas of the horse, or so that the saddle will flex or bend to conform to the shape of the horse. A number of these previous proposals are described in U.S. Pat. No. 4,745,734. Other saddles have been provided with foam cushion layers, such as those described in U.S. Pat. No. 4,716,715.

Encapsulated gel material has been employed in anatomical cushions, such as seats or saddles for racing bicycles. Some of these are described in U.S. Pat. Nos. 4,815,361 and 4,999,068. In these cases an encapsulated gel member is combined with a foam cushion and its geometry is tailored to give the rider graduated support. These gels can be organosiloxane compounds. The gels tend to permit lateral or front and back travel, and must be constrained and limited to restricted portions of the seat. As such, these gels would be unsuited for use in equestrian saddles.

A saddle pad employing a rheopexic fluid contained in a deformable sealed chamber has been proposed in U.S. Pat. No. 4,471,538. A rheopexic fluid molds itself to a user's body part, but when left at rest it flows back to its initial state. Because the active material is fluid, it must be contained in chambers and can only cover selected portions of the seat. There is no contemplation of the use of a rheopexic fluid, or gel, or any other similar material for the pad or cushion of the panels to protect or cushion the horse.

None of these previous proposals in the saddlery arts has addressed the need to absorb energy so that bouncing is avoided and transmission of shock to the rider or to the horse is also avoided.

OBJECT AND SUMMARY OF THE INVENTION

It is an object of this invention to provide a horse saddle that avoids the drawbacks of the prior art.

It is another object to provide a saddle that avoids pressure concentrations in the contact area on the seat to increase rider comfort.

It is still another object to provide a saddle that absorbs shock and bounce of the rider on the saddle.

In accordance with an aspect of the invention, the saddle is built on a saddle tree which is of generally conventional configuration, with left and right side frame members a rear cantle holding the rear ends of the side from members and a front bow joining the front ends of the side frame members. A web seat base is made of a longitudinal web member stretched between the cantle and the bow and a number of transverse web members stretched over the transverse members and between the left and right side frame members. This is covered with muslin and the cushion layer is installed on top of it. The cushion layer is molded silicone dielectric gel profiled to fit onto the seat base and is on the order of one-half inch thick. The cushion layer can have a coating of neoprene or other rubber-like material. The leather cover is installed over the cushion layer. The gel layer is preferably made of a suitable two-part silicone, such as Sylgard 527, manufactured by Dow Corning or RTV 6157 silicone gel manufactured by General Electric Company. These gels when properly prepared and used have the properties of (a) high energy absorbency to absorb shock and bounce of the rider on the saddle, and (b) resilient displaceability under both vertical and lateral forces to distribute the rider's weight evenly over the contact area of the saddle and avoid pressure concentrations within the contact area.

Preferably, the panels can also include a layer of the silicone dielectric gel to cushion the horse from the saddle to further absorb bounce and/or shock, and avoid pressure concentrations on the area where the saddle contacts the horse's back.

The above and many other objects, features and advantages of the invention will be more fully understood from the ensuing description of a preferred embodiment, to be read in conjunction with the accompanying Drawing.

DETAILED DESCRIPTION OF THE PREFERRED EMBODIMENT

Figure 1:
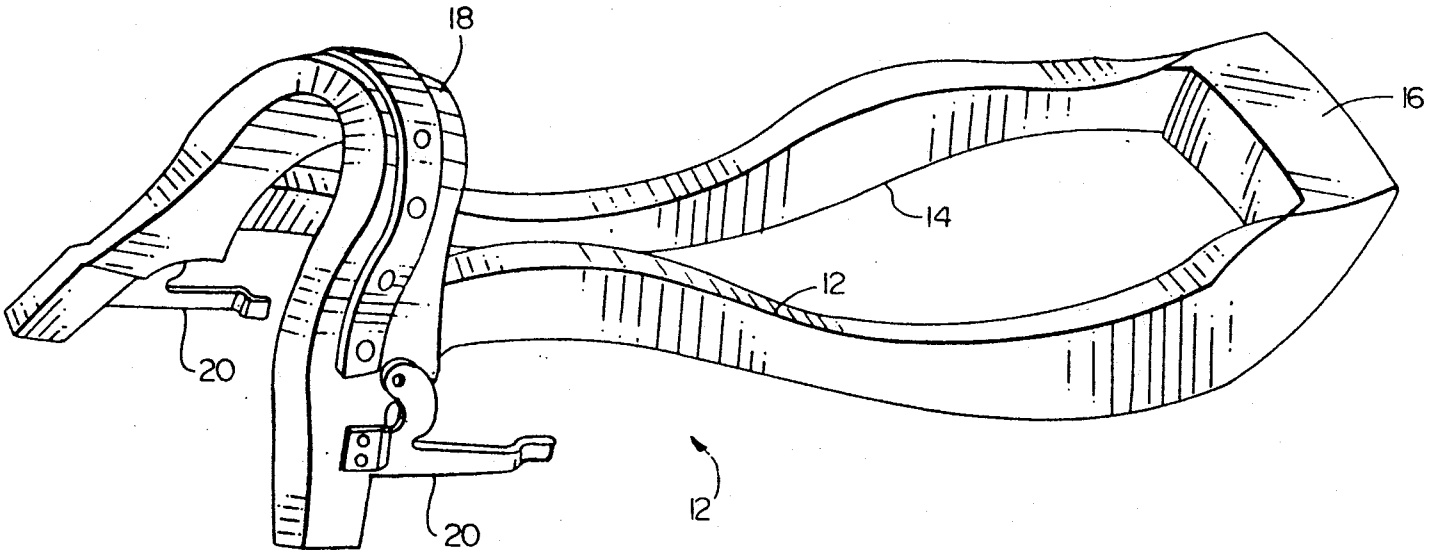
FIG. 1 is a perspective view of a saddle tree on which is formed the saddle according to one preferred embodiment of the invention.
Figure 2:
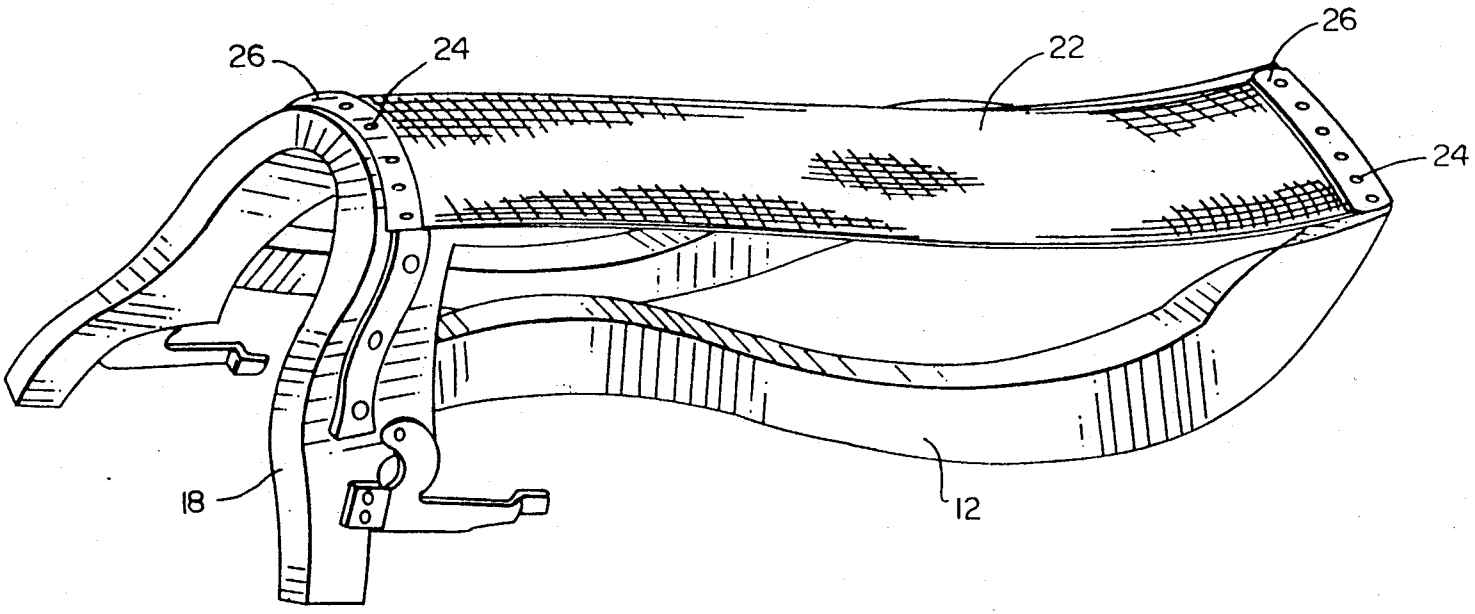
FIG. 2 to 5 are perspective views showing the saddle of the preferred embodiment in progressive stages of assembly.

With reference to the Drawing and initially to FIG. 1, a riding saddle is built up from a generally traditional wooden saddle tree which is formed of a wood left side member 12, a wood right side member 14, a rear cantle 16 connecting the rear ends of the side members and a head piece or bow 18 connecting the front ends of the side members. The side members 12, 14 bend inward somewhat near the bow to define a waist for the tree 10. Also mounted on the bow are left and right support irons 20 on which stirrups, skirts and fenders can be supported. As shown in FIG. 2, a longitudinal web 22 of prestressed canvas is attached onto the bow 18 and cantle 16 and is secured by tingles 24 which are small smooth-head nails or tacks. Here leather strips 26 are disposed on the ends of the web 22 and prevent the canvas web from coming away from the tingles.

Figure 3:
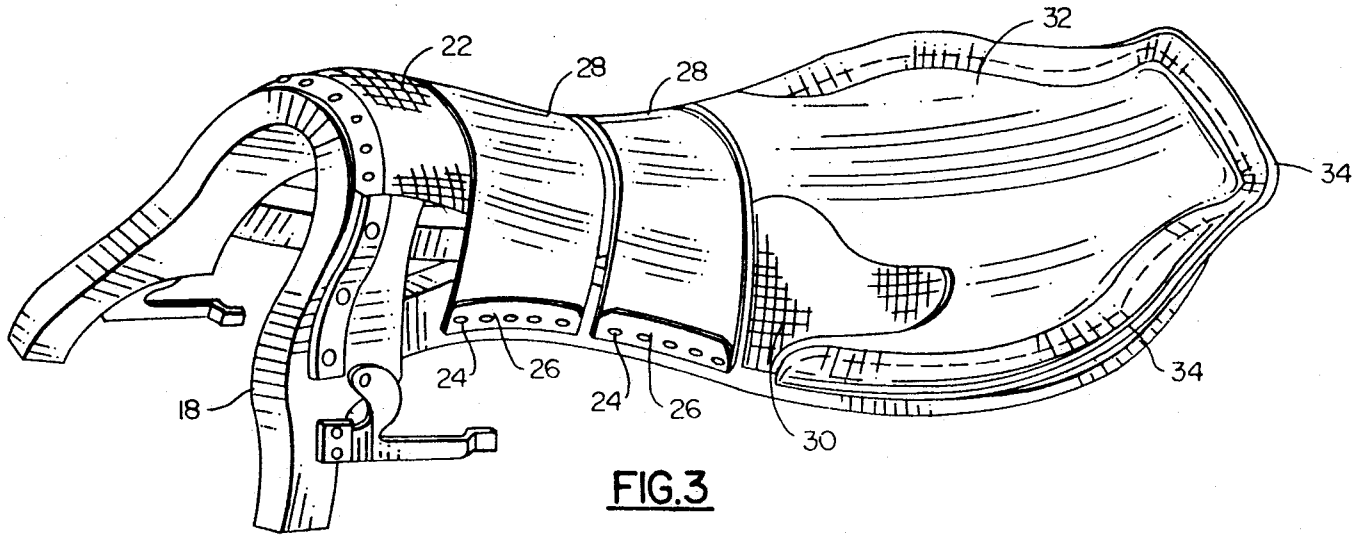

Transverse strap webs 28 are placed across the longitudinal web 22 at a waist or narrow portion of the tree 10, as shown in FIG. 3. These webs 28 are stretched in place and attached by tingles 24 and leather strips 26 to the side members 12, 14 of the saddle tree. Girth straps (not shown) can be favorably attached by sewing onto these strap webs 28. Behind the strap webs 28 are one more back webs 30 also stretched over the web 22 and tacked down to the side members 12 and 14. A straining canvas 32, shaped to cover the entire seating area defined by the back webs 30 behind the waist, is stretched tightly and tacked down into the side members 12, 14 and the cantle 16.

The combination of the tightly drawn crossing webs provides a firm spring-like seat base for the rider.

Small crescent-shaped leather pieces, or bellies 34, are nailed to edges of the tree side members to relieve discomfort from the hard edges. Alternatively, the saddle tree could be provided with rubber edges. Then, the entire web seat can be covered with a muslin or similar undercover, and provided with padding or cushioning. The traditional, old-style pad is formed of wool, but conventional seat cushions are now formed of rubber foam or resilient plastic foam.

Figure 4:
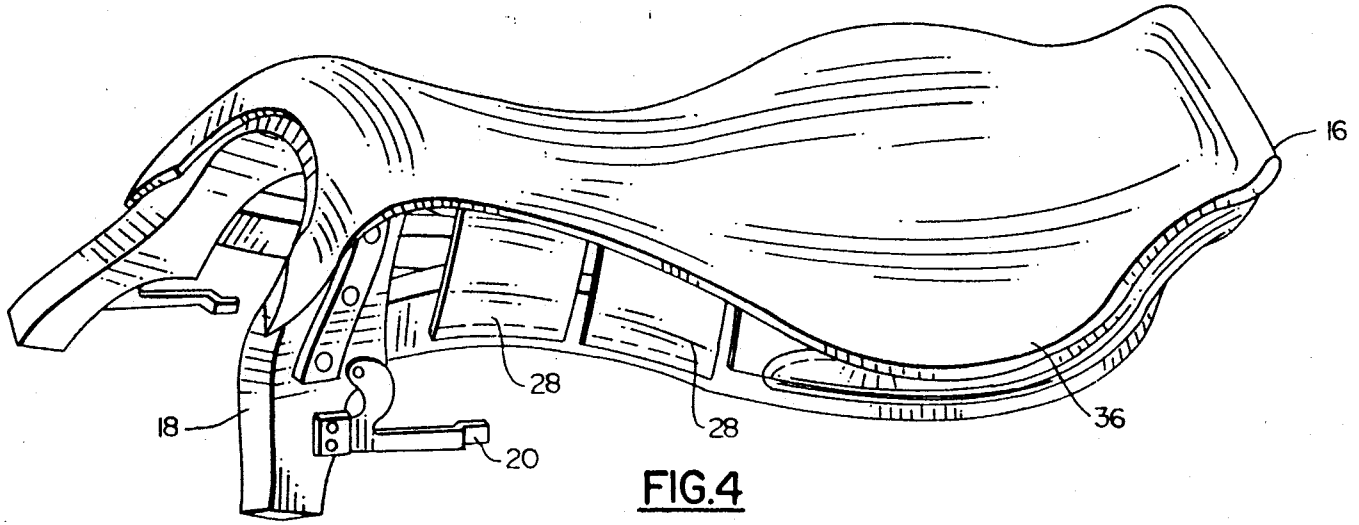

In this embodiment, the pad or cushion 36 (FIG. 4) is made of a silicone dielectric gel, such as Sylgard 527 as obtained from Dow Corning. This is a two-component silicone gel, and is often used for potting electrical or electronic components. For this pad, a pattern is made of a convenient material, such as foamed urethane. Then a negative form or mold is made, and the two components of the gel are mixed together and poured into the mold. When the gel sets, it is removed from the mold and is ready to be installed as the pad or cushion. The cushion is preferably about a half-inch thick, and covers the entire seat area, as illustrated. Thereafter a sheet of thin muslin or other cloth is stretched over it and affixed to the tree 10. The last covering for the seat is a leather cover 40, preferably either pigskin or calfskin.

Figure 6:
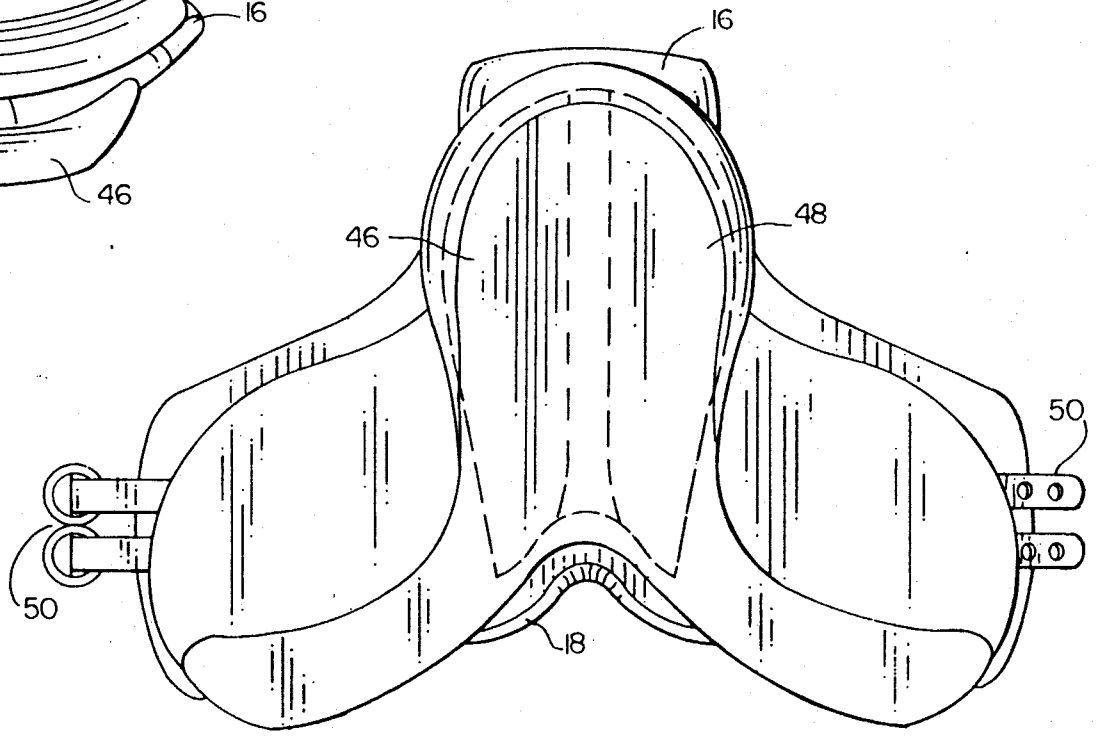
FIG. 6 is a bottom view of the saddle taken at 6—6 of FIG. 5.
Figure 5:
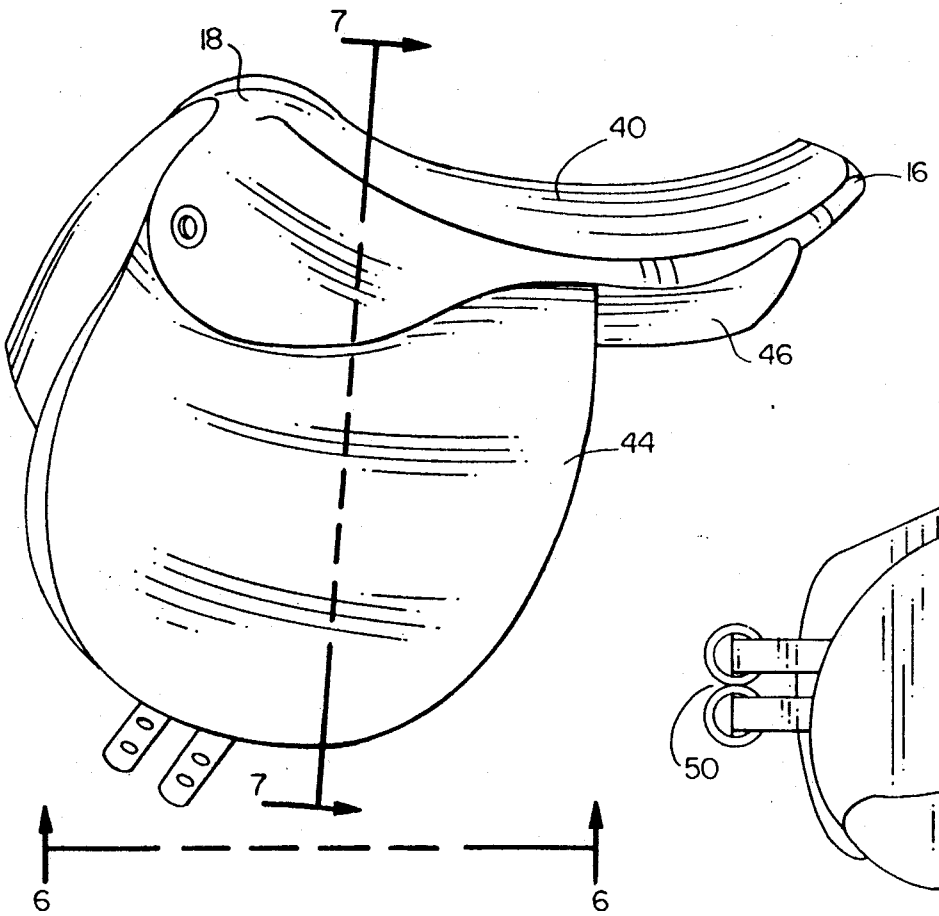
Figure 7:
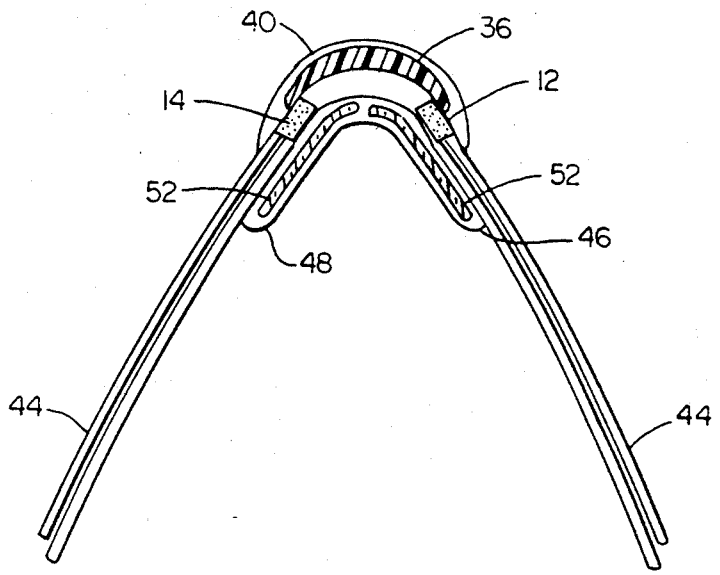
FIG. 7 is a cross section taken at 7—7 of FIG. 5.

As shown in FIGS. 5, 6 and 7, leather skirts 44 as well as left and right panels 46, 48 are provided. The panels are shaped to cushion the back of the horse from the saddle tree 10, and hence are placed beneath the respective tree frame side members 12 and 14. The traditional panel is made of two layers of hide filled either with wool or with cut pieces of plastic resilient foam. However, in a preferred embodiment the silicone gel is used as the cushioning material 52 in the panels as shown in cross section in FIG. 7.

Figure 8:
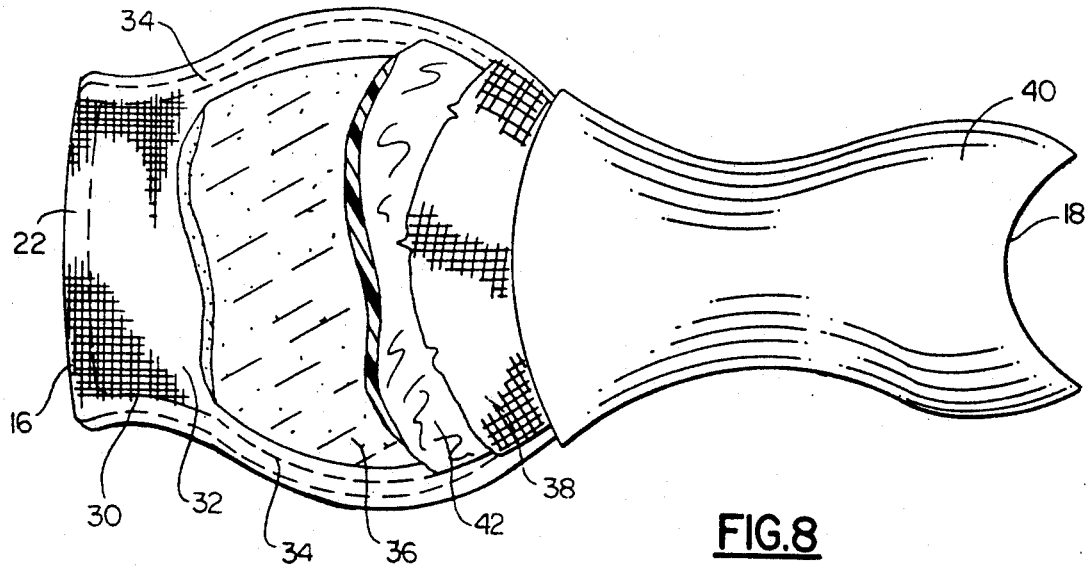
FIG. 8 is a top view of the saddle seat, shown partially cut away to reveal component parts thereof.

FIG. 8 shows the various layers of the saddle seat, with the web 22 connected from the head or bow 18 to the cantle 16, the transverse back web 30 over the longitudinal web 22, the straining canvas 32 on the back web 30, and the gel cushion 36 supported on the seat base defined by the webs and the straining canvas. Here there is a thin coating 42 of neoprene on the cushion, which facilitates handling and installation, taking account of the surface tackiness of the gel material. FIG. 8 finally shows the muslin cloth cover 38 followed by the supple pigskin as calfskin outer covering 40.

Girth straps 50 are shown in FIGS. 5 and 6.

The silicone gel employed here as the cushion 36 and optionally also as the panels 46, 48 has important attributes that make it far superior to other materials, and especially superior to foam, for equestrian saddles.

The silicone dielectric gel has a high absorbency of kinetic energy, and hence absorbs shock and bounce of the rider on the saddle. This not only provides a safer and more comfortable ride, but prevents shock forces from being amplified and transmitted to the horse. Also, this gel material is resiliently displaceable both vertically and laterally. This feature serves to distribute the rider's sitting weight evenly over the contact area of the saddle. By contrast, foam cushions compress vertically only, and develop pressure concentrations at the center of the contact area.

Likewise gel padded panels have similar attributes of absorbing of shock forces and bounce, and spreading the weight of the saddle and rider evenly over the back of the horse. This avoids pressure concentrations between the saddle tree and the horse's withers where the saddle rests and prevents bruises and other injuries to the horse that can result from the pressure of the saddle.

While the invention has been described in detail with reference to a preferred embodiment, it should be understood that the invention is not limited to that precise embodiment. Rather, many modifications and variations will present themselves to those skilled in the art without departing from the scope and spirit of this invention, as defined in the appended claims:

What is claimed is:

1. Equestrian saddle for mounting a rider on a horse, comprising a tree frame including left and right longitudinal frame members, a rear cantle joining rear ends of the left and right frame members, and a front bow joining the front ends of the left and right frame members; at least one longitudinal web stretched between the bow and the cantle; a series of cross webs attached to the left and right frame members and stretched over the longitudinal web, said webs together forming a firm spring-like seat base; a seat cushion layer disposed on said seat base; a leather cover fitted over said cushion layer and said tree frame and forming a seat on which said rider is in sitting contact to define a contact area on the seat; and at least one panel disposed beneath the left and right frame members to cushion said tree frame as it rests on the horse; and the improvement wherein said seat cushion layer is formed of a silicone dielectric gel molded in a profile to match the web seat base and being approximately one-half inch thick and having the properties of (a) high energy absorbency to absorb shock and bounce of the rider on the saddle, and (b) resilient displaceability under both vertical and lateral forces to distribute the rider's sitting weight evenly over the contact area of the saddle and avoid pressure concentrations within the contact area.

2. The saddle of claim 1 wherein the left and right side members of said saddle tree frame are wood.

3. The saddle of claim 2 wherein said side members bend inward near the bow to define a waist of said tree.

4. The saddle of claim 2 wherein said side members bend inward near the bow to define a waist of said tree.

5. The saddle of claim 1 wherein the left and right side members of said saddle tree frame are wood.

6. The saddle of claim 1 wherein said webs are formed of a canvas material.

7. The saddle of claim 1 wherein said silicone dielectric gel is a cured two-component material.

8. The saddle of claim 1 wherein said at least one panel includes a cushion layer formed of a silicone dielectric gel covering an underside of each of said tree frame side member, and having the properties of high energy absorbency to absorb shock and bounce of the saddle on the horse and resilient displaceability under both vertical and lateral forces to distribute the weight of the rider and saddle evenly over a contact area of the saddle on the horse and to avoid pressure concentrations within the contact area.

* * * * *